US008555471B2

(12) United States Patent
Rojdev

(10) Patent No.: US 8,555,471 B2
(45) Date of Patent: Oct. 15, 2013

(54) CASKET AND ORNAMENT THEREFORE

(75) Inventor: Ilija Rojdev, Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 199 days.

(21) Appl. No.: 13/242,594

(22) Filed: Sep. 23, 2011

(65) Prior Publication Data

US 2013/0074299 A1 Mar. 28, 2013

(51) Int. Cl.
*A61G 17/00* (2006.01)

(52) U.S. Cl.
USPC ..... 27/14; 27/19

(58) Field of Classification Search
USPC ..... 27/14, 19, 2, 10; 220/376; 40/1.5, 40/124.5, 600, 621; 428/542.4; D99/8, 10, D99/13; 24/303, 90.1, 114.9
See application file for complete search history.

(56) References Cited

U.S. PATENT DOCUMENTS

| | | | | |
|---|---|---|---|---|
| 2,659,169 | A * | 11/1953 | Brennan | 40/1.5 |
| 6,038,944 | A | 3/2000 | Braunberger | |
| 6,393,686 | B1 | 5/2002 | Braunberger | |
| 6,431,027 | B1 | 8/2002 | Braunberger | |
| 6,557,222 | B2 | 5/2003 | Groemminger et al. | |
| 6,591,466 | B1 | 7/2003 | Acton et al. | |
| 6,594,871 | B2 * | 7/2003 | Hoffman | 24/303 |
| 6,691,385 | B2 | 2/2004 | Bell et al. | |
| 6,723,447 | B1 | 4/2004 | Braunberger | |
| 6,883,212 | B2 | 4/2005 | Groemminger et al. | |
| 6,928,706 | B2 | 8/2005 | Acton et al. | |
| 6,938,518 | B1 * | 9/2005 | Braunberger | 79/1 |
| 7,210,204 | B2 | 5/2007 | Groemminge et al. | |
| 7,340,810 | B2 | 3/2008 | Acton et al. | |
| 8,220,119 | B2 * | 7/2012 | Burlage et al. | 27/14 |
| 8,387,219 | B2 * | 3/2013 | Rojdev | 27/10 |
| 8,429,840 | B2 * | 4/2013 | Mottola | 40/590 |
| 2010/0299895 | A1 | 12/2010 | Burlage et al. | |
| 2012/0192390 | A1 * | 8/2012 | Burlage et al. | 27/14 |

OTHER PUBLICATIONS

Tecre Co., Inc. Button Assembly Machines Model 300/500 Instruction Manual, 3 pages.
Master Magnetics, Inc. Neodymium Disc Magnets, 2 pages, downloaded at http://www.magnetsource.com/Solutions_Pages/DISCSneo.html.
Buy Button Parts 2-1/4 Snap-In Pinback Buttons, 2 pages, downloaded at http://www.buybuttonparts.com/2-1-4-Snap-In-Pinback-Buttons.html.
Blick Snap-In Plastic Buttons, 1 paged, downloaded at http://www.dickblick/com/products/snap-in-plastic-buttons/.

* cited by examiner

*Primary Examiner* — William Miller
(74) *Attorney, Agent, or Firm* — Wood, Herron & Evans, LLP; Wayne L. Jacobs

(57) ABSTRACT

A casket comprises a casket shell adapted to receive the remains of a deceased and a casket cap closable on the casket shell. The cap includes a dish assembly mounted to an underside thereof including a cap panel of a sheet of magnetic material. At least one medallion is removably mounted on the cap panel. The medallion comprises a medallion blank having at least one magnet on a rear side thereof and having a recess on a front side thereof, and a button removably received in the recess of the medallion blank. The button comprises a button front, a magnetic metallic button back, and a two-dimensional image overlying an upper surface of the button front.

26 Claims, 5 Drawing Sheets

CASKET AND ORNAMENT THEREFORE

RELATED APPLICATIONS

N/A.

FIELD OF THE INVENTION

This invention relates generally to caskets, and more particularly to caskets having memorialization features such as casket ornaments and to casket ornament constructions.

BACKGROUND OF THE INVENTION

When an individual passes away it is customary for the body of the individual to be viewed by family and friends at a funeral home. After the viewing, a funeral or other memorial service is generally held at the funeral home or a church to commemorate the life of the deceased. Thereafter, a grave side service may be held with family and friends looking on. With the completion of the grave side service the casket is lowered into the grave where it will remain. A similar service may be held prior to or after the deceased is cremated. Usually after cremation the cremated remains are collected and presented to the family in a cremation urn.

The casket in which the deceased is displayed can be customized to fit the needs and preferences of the deceased and the family. For instance, a wide variety of materials, finishes, colors and decorative ornamentation can be chosen to meet these needs. The purchaser of a casket can also customize the casket using a variety of interchangeable stylized trim, for example, corner ornaments. The purchaser may select from a number of stylized corner ornaments each of which has been ornamented to represent a "theme." The purchaser thus selects a corner ornament design having a theme representative of an aspect of the deceased's life to personalize the casket, for example, a golf corner ornament design could be selected for installation on the casket to reflect that the deceased was an avid golfer.

Once the casket is buried or the deceased is cremated and the funeral or other memorial service is completed, the families are left with few tangible reminders of the funeral or memorial service. Most families receive flowers at the funeral home which pay respect to the deceased and his or her surviving family. These flowers, however, wilt and die after a short time, leaving the family with few remembrances of the funeral or memorial service. It is desirable for the families to receive a more tangible and permanent reminder of the funeral or memorial service.

Prior solutions to this need may be seen in the quick change casket ornament of the assignee's U.S. Pat. Nos. 7,340,810, 6,928,706, and 6,591,466, which may be removed from the casket and mounted on either the plaque of the assignee's U.S. Pat. Nos. 7,210,204, 6,883,212, and 6,557,222 or the pedestal of the assignee's U.S. Pat. No. 6,691,385 and presented to a family member or loved one of the deceased. All of these patents are hereby incorporated by reference herein as if fully set forth in their entirety.

Another more recent solution to this need may be seen with reference to the assignee's U.S. patent application Ser. No. 12/605,073 for Memorial Casket and Method, hereby incorporated by reference herein as if fully set forth in its entirety. In this application there is disclosed a casket comprising a casket shell adapted to receive the remains of a deceased and having a pair of side walls, a pair of end walls, and a bottom wall, a casket cap closable on the casket shell, and at least one medallion mounted on either an interior surface or an exterior surface of either the cap or the shell, the medallion having text and/or graphics representing a life aspect of the deceased. In one embodiment, the cap includes a dish assembly mounted to an underside of the cap. The dish assembly includes a cap panel comprising a sheet of magnetic material. The medallion has a magnet on a rear side thereof that allows the medallion to be mounted on the cap panel in any desired position.

A typical medallion of the type used with the casket of application Ser. No. 12/605,073 is on the order of about 4.25 inches in diameter and is cast in a die from pewter or aluminum. The die includes a three-dimensional image of the desired life aspect of the deceased; that three-dimensional image is cast into the medallion during the casting process. Once the medallion has been cast and removed from the die, the three-dimensional image of the medallion is hand-painted.

While this type of medallion has met with success, the production process of this type of medallion is expensive, tedious, and time consuming. Each different life aspect image requires a separate die. The dies can be expensive, and each die can take weeks to produce. Depending on the popularity of a particular life image, its respective die may only be used a few times to produce only a few medallions, thus driving up the cost per medallion for that particular life image. Each medallion, once cast, must have its three-dimensional image hand painted, which is tedious and time consuming.

It would be desirable to devise a casket medallion which is less expensive to produce, takes less time to produce, and which requires less labor to produce.

SUMMARY OF THE INVENTION

In one aspect, a casket comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel, the cap panel comprising a sheet of magnetic material, and at least one medallion removably mounted on the cap panel, the medallion having at least one of text and graphics representing a life aspect of the deceased. The medallion comprises a medallion blank having at least one magnet on a rear side thereof and having a recess on a front side thereof, and a button removably received in the recess of the medallion blank, the button comprising a button front, a magnetic metallic button back, and a two-dimensional image overlying an upper surface of the button front, the at least one magnet removably securing the medallion blank to the magnetic material of the cap panel, the at least one magnet removably securing the button in the recess of the medallion blank.

The button can be of the type having a metallic button front, a transparent sheet of material overlying the two-dimensional image, and a circumferential edge of the button front crimped to a circumferential edge of the button back to secure the two-dimensional image and transparent sheet of material to the button. The medallion blank can be circular and the recess in the medallion blank can also be circular. The medallion blank can further include a circumferential groove between a periphery of the recess and a periphery of the medallion blank.

In another aspect, a method of personalizing a casket comprises providing a medallion blank having at least one magnet on a rear side thereof and having a recess on a front side thereof, assembling a button comprising a button front, a magnetic metallic button back, and a two-dimensional image overlying an upper surface of the button front, removably securing the button in the recess of the medallion blank via the at least one magnet on the rear side of the medallion blank, and removably securing the medallion blank to the magnetic material of the cap panel via the at least one magnet on the rear side of the medallion blank.

The step of assembling the button can further comprise receiving the two-dimensional image from a loved one of the deceased. The button front can be metallic, and the step of assembling the button can further comprise the steps of overlying the button front with the received two-dimensional image, overlying the two-dimensional image with a transparent sheet of material, and crimping a circumferential edge of the button front to a circumferential edge of the button back to secure the two-dimensional image and transparent sheet of material to the button.

In another aspect, a casket comprises a casket shell adapted to receive the remains of a deceased and having a pair of side walls, a pair of end walls, and a bottom wall, a casket cap closable on the casket shell, the cap including a dish assembly mounted to an underside thereof, the dish assembly including a cap panel, the cap panel comprising a sheet of magnetic material, and at least one medallion removably mounted on the cap panel, the medallion having at least one of text and graphics representing a life aspect of the deceased. The medallion comprises a medallion blank having at least one magnet on a rear side thereof and having a recess on a front side thereof, and a button received in the recess of the medallion blank, the button comprising a button front, a button back, and a two-dimensional image overlying an upper surface of the button front, the at least one magnet removably securing the medallion blank to the magnetic material of the cap panel.

In another aspect, a method of personalizing a casket comprises providing a medallion blank having at least one magnet on a rear side thereof and having a recess on a front side thereof, assembling a button comprising a button front, a button back, and a two-dimensional image overlying an upper surface of the button front, securing the button in the recess of the medallion blank, and removably securing the medallion blank to the magnetic material of the cap panel via the at least one magnet on the rear side of the medallion blank.

In another aspect, a medallion for attachment to a casket, attachment to a cremation urn, and/or presentation to a loved one of the deceased as a keepsake, the medallion having text and/or graphics representing a life aspect of the deceased, comprises a medallion blank having a recess on a front side thereof, and a button received in the recess of the medallion blank, the button comprising a button front, a button back, and a two-dimensional image overlying an upper surface of the button front.

The button can be removably received in the recess of said medallion blank. The medallion can have at least one magnet on a rear side thereof. The button can comprise a magnetic metallic button back, the magnet removably securing the button in the recess of the medallion blank. The button front and back can be metallic, a transparent sheet of material can overlie the two-dimensional image, and a circumferential edge of the button front can be crimped to a circumferential edge of the button back securing the two-dimensional image and transparent sheet of material to the button. The medallion can be circular and the recess in the medallion blank can be circular. The medallion blank can further include a circumferential groove between a periphery of the recess and a periphery of the medallion blank. The button front and back can also be made of plastic. The button front and back can be configured to define a cavity adapted to contain cremation remains. The button back can include a hole through which the cremation remains may be introduced into the cavity, and a closing device for closing the hole to contain the cremation remains in the cavity.

The casket and ornament of this invention provide a number of advantages. Only a single medallion die is required—one for the medallion blank. Only a single type of medallion need be kept in stock by the funeral director—the medallion blank. The funeral director has the capability to make custom medallions onsite. A family member need only provide the funeral director with a photo, and the funeral director can assemble onsite a button with commercially available button producing apparatus (or snap together button parts) that displays the photo. The button is then installed into the medallion blank, and the fully assembled medallion is then installed on the casket. Multiple expensive medallion dies, each taking weeks to produce, are no longer required. Tedious and time consuming hand painting of three-dimensional medallions is no longer required.

DETAILED DESCRIPTION OF THE DRAWINGS

Figure 1:
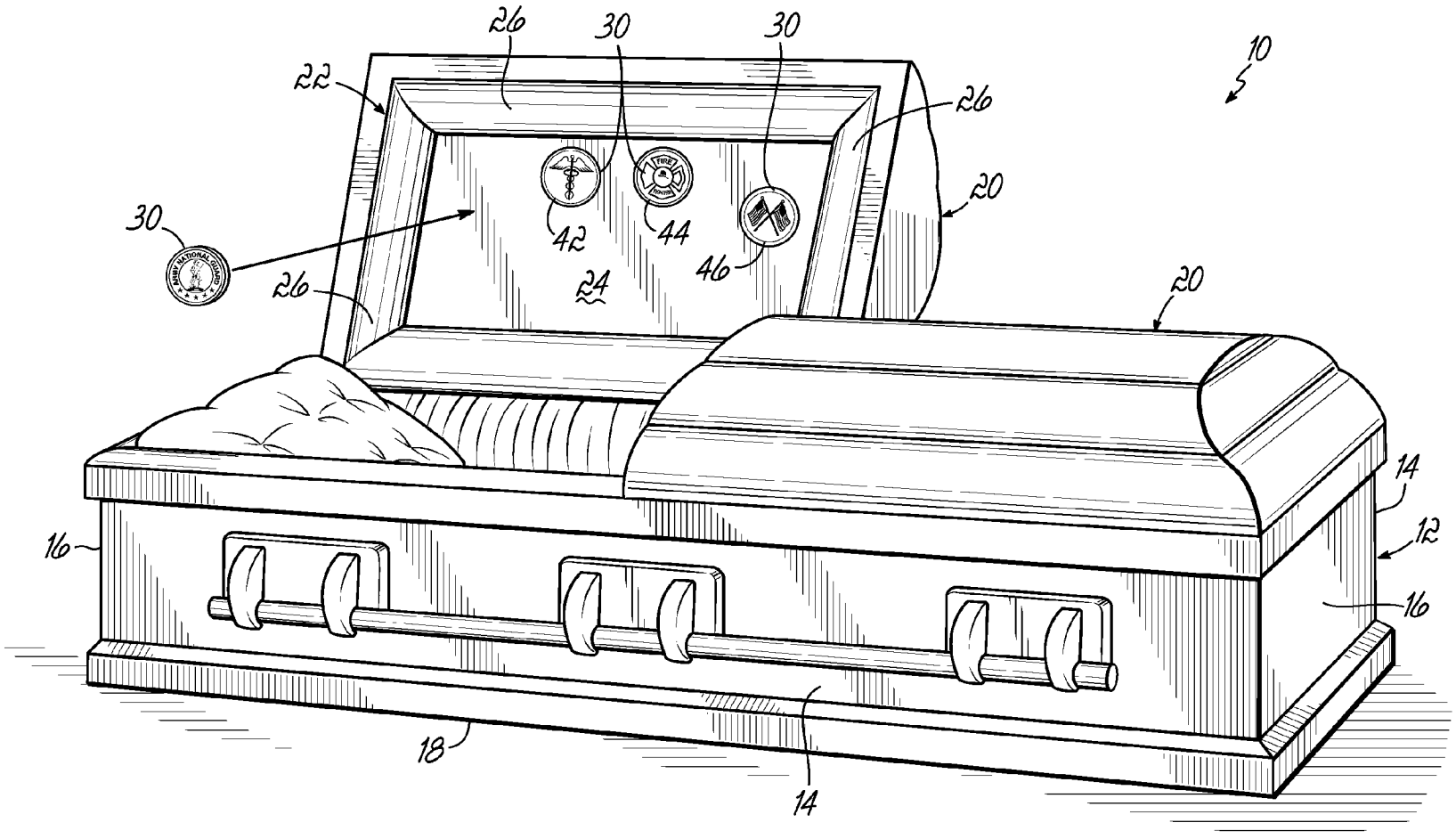
FIG. 1 is a perspective view of a casket according to the principles of the invention.

Referring to FIG. 1, a casket 10 has a shell 12 adapted to receive the remains of a deceased having a pair of side walls 14, 14, a pair of end walls 16, 16, and a bottom wall 18, and a cap 20 closable on the shell 12. The casket may have a pair of caps or a single cap the full length of the casket. Cap 20 has an ornamental dish assembly 22 mounted to an underside of the cap 20. The dish assembly 22 includes a cap panel 24 and may include ornamental puffing members 26 mounted around a periphery of the dish assembly 22. One or more medallions 30 are mounted to the cap panel 24 of the dish assembly 22. The medallion 30 has text and/or graphics representing a life aspect of the deceased, for example, Father, Brother, Husband, Lawyer, Christian, Hunter, Fisherman, etc.

Figure 2:
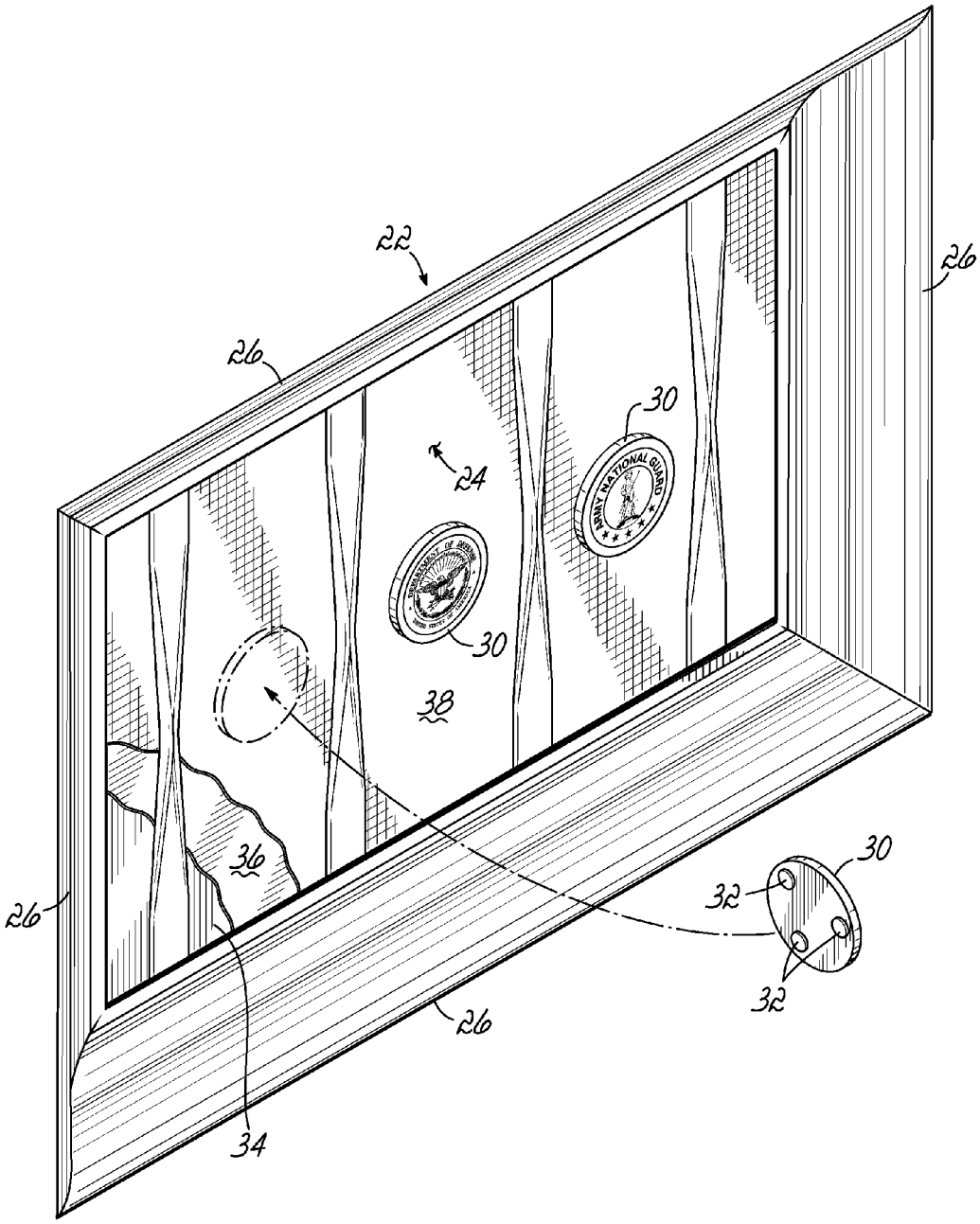
FIG. 2 is a perspective view of the casket cap dish assembly and medallions.
Figure 3:
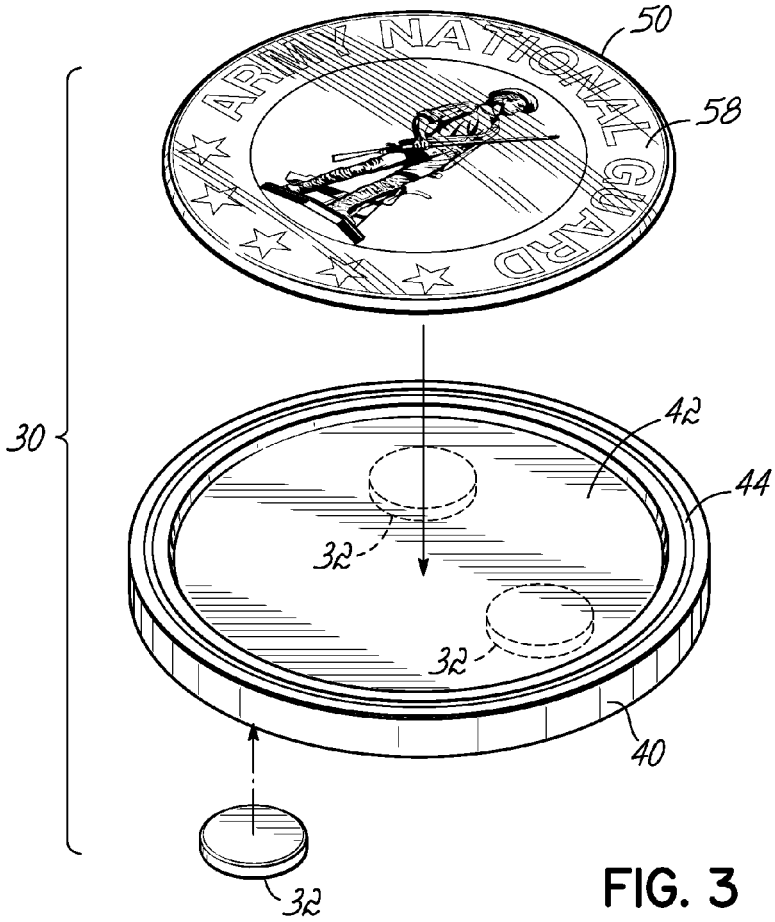
FIG. 3 is an exploded perspective view of a medallion blank and button.
Figure 5:
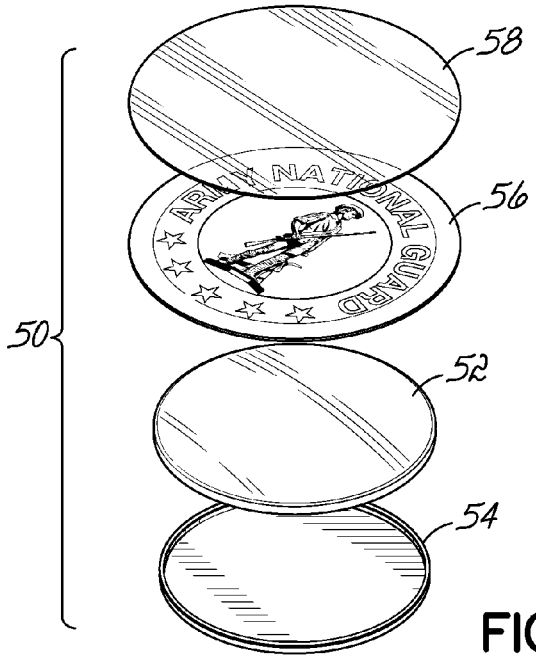
FIG. 5 is an exploded perspective view of a button.
Figure 4A:
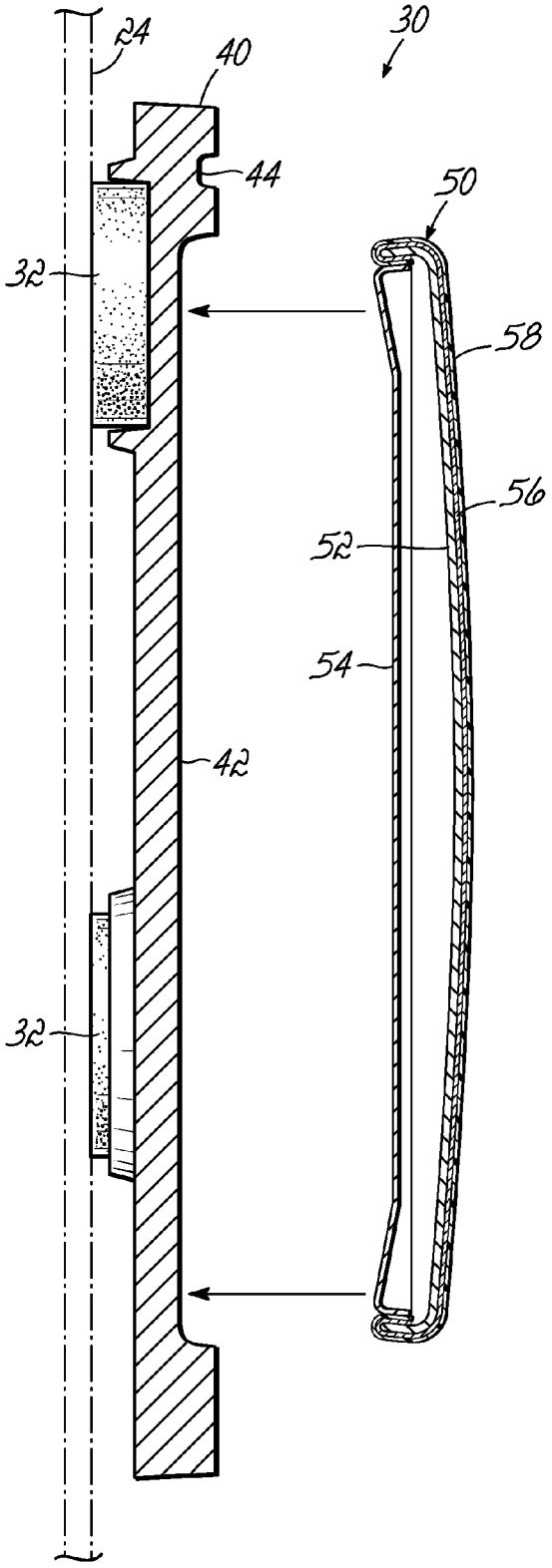
FIGS. 4A and 4B are cross-sectional views of the medallion blank and button of FIG. 3.
Figure 4B:
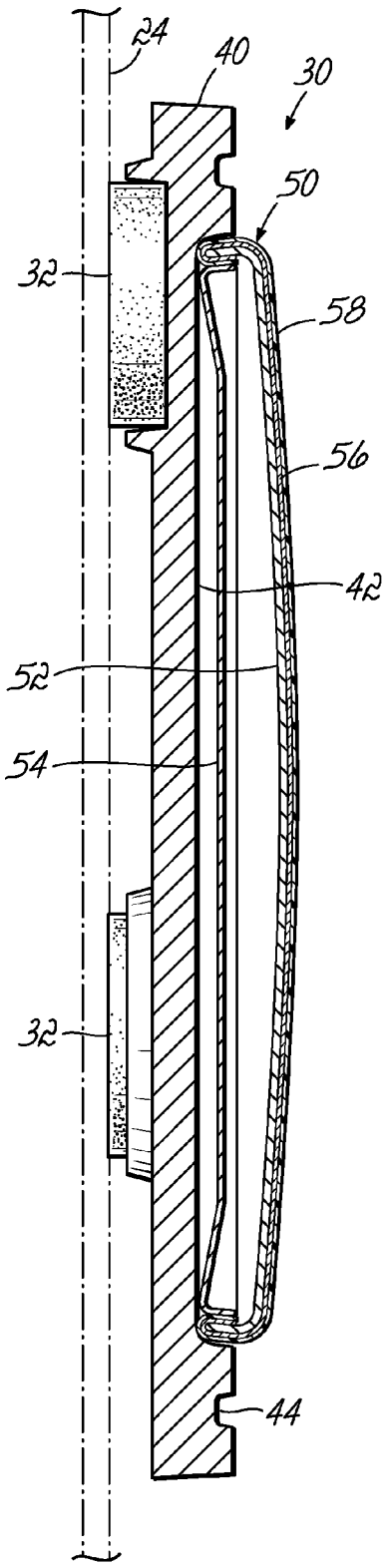

Referring to FIG. 2, the dish assembly 22 is constructed in such a way as to permit medallions 30 to be placed anywhere on the cap panel 24. More particularly, each medallion 30 has one or more magnets 32 secured on a rear side thereof, for example permanently secured in recesses on/in the rear side thereof with adhesives or the like. The cap panel 24 is fabricated from a sheet of cardboard or chipboard 34 over which is placed a sheet of magnetic material 36, for example steel. The sheet of magnetic material 36 is then covered with a sheet of decorative material 38. Since the entire surface area of the cap panel 24 is magnetic material, medallions 30 can be placed anywhere within the surface area of the cap panel 24. This permits more freedom in placing and arranging medallions as desired by the funeral director and family, friends, and loved ones of the deceased.

Referring to FIGS. 3, 4A, 4B, and 5, the medallion 30 comprises a medallion blank 40 and a button 50. Medallion blank 40 has a recess 42 on a front side thereof; the button 50 is received in the recess 42 of the medallion blank 40. The button 50 comprises a button front or shell 52, a button back 54, and a two-dimensional image 56, for example photograph, clip art or other artwork, etc., overlying an upper surface of the button front 52. A transparent sheet of material 58, for example MYLAR® film, can overly the two-dimensional image 56 to protect it. A circumferential edge of the button front 52 is crimped to a circumferential edge of the button back 54 to secure the two-dimensional image 56 and transparent sheet of material 58 to the button 50, trapping the circumferential edges of the two-dimensional image 56 and transparent sheet of material 58 between the circumferential edges of the button front 52 and button back 54.

The button 50 can be made with a commercially available button making machine such as the model 350 available from Tecre Co., Inc., Fond du Lac, Wis. Various button making machines and methods of Tecre Co., Inc. are disclosed is its U.S. Pat. Nos. 6,038,944, 6,393,686, 6,431,027, and 6,723,447, hereby incorporated by reference herein as if fully set forth in their entirety, and may be consulted with respect to the method of making the button 50.

Due to the strength of the magnets 32 and the materials from which the button 50 are manufactured (steel), the magnets are able to advantageously removably secure the button 50 within the recess 42 of the medallion blank 40 as well as removably secure the medallion 30 to the cap panel 24. Acceptable magnets 32 which perform in this manner are neodymium magnets, for example the model ND007509N available from Master Magnetics, Inc., Castle Rock, Colo. Alternatively, the button 50 could be secured, removably or otherwise, in the recess 42 of the medallion blank 40 in other ways. For example, a thin steel disk could be affixed in the recess 42 of the medallion blank 40 and a thin sheet magnet could be secured (for example adhesively secured) to the back 54 of the button 50. Or, a thin sheet magnet could be secured (for example adhesively secured) in the recess 42 of the medallion blank 40 which would removably secure the steel button 50 in the recess 42. Or, hook and loop fasteners, double-sided adhesive tape, or adhesives could be used to secure the button 50 in the recess 42 of the medallion blank 40.

Alternatively, button 50 can be of the type that does not require a button making machine. This type of button 50 is fabricated of plastic and has a cover and a back that snap together by hand capturing the two-dimensional image between the front and back.

The medallion blank 40 can be circular and the recess 42 in the medallion blank 40 can also be circular. The button 50 is circular and has a diameter slightly smaller than the recess 42 in the medallion blank 40. The medallion blank 40 can further include a one or more decorative circumferential grooves 44 positioned radially between a periphery of the recess 42 and a periphery of the medallion blank 40.

Figure 6:
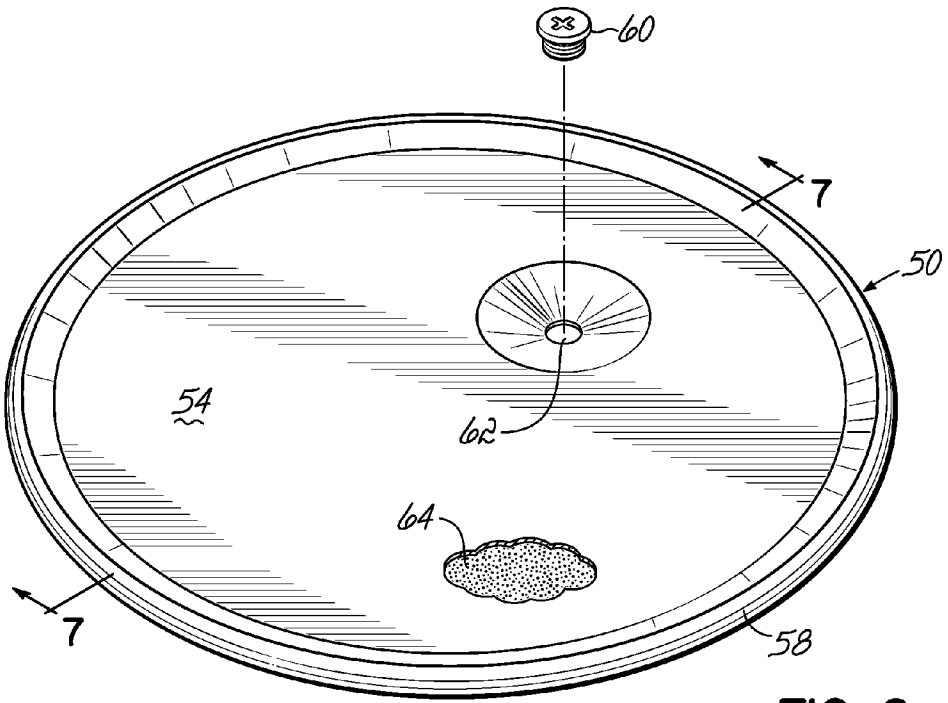
FIG. 6 is a rear perspective view of an alternative embodiment of the button.
Figure 7:
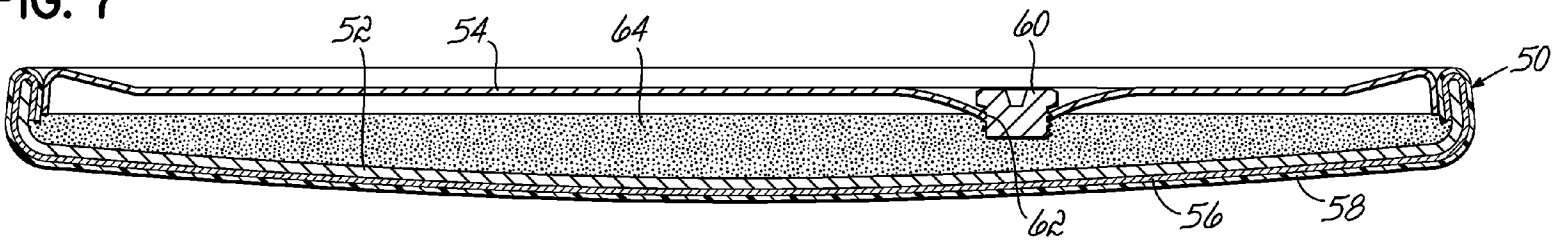
FIG. 7 is a cross-sectional view taken along line 7-7 in FIG. 6.

Referring now to FIGS. 6 and 7, an alternative embodiment of button 50 is illustrated. In this embodiment of button 50, which can be either of the metallic (steel) construction or plastic construction discussed above, the back 54 of the button 50 is provided with a recessed hole or aperture 62 through which cremation remains 64 may be introduced into the cavity between the front 52 and back 54 of the button. A screw 60 or other fastener or closing device closes the hole 62 to contain the cremation remains in the button 50. The recessed nature of the hole 52 prevents the screw 60 from interfering with the ability of the button 50 to lie flat or flush against a surface, for example bottom surface of recess 42 in medallion blank 40, as well as provides a "funnel" for pouring the remains into the hole 62. The button cremation urn 50, with or without the medallion blank 40, can be presented to a friend, family member, or other loved one of the deceased as a keepsake.

In use, a funeral director need only keep medallion blanks in stock. The funeral director can purchase and keep on hand a button making machine, for example of the type offered by Tecre Co., Inc., along with button making supplies for the machine, or purchase and keep on hand plastic button fronts and backs assembleable by hand. Friends, family, and other loved ones of the deceased can provide the funeral director with two-dimensional images such as photos, clip art, other artwork, etc., and the funeral director can make custom medallions within a matter of minutes with medallion blanks and buttons assembled with the provided two-dimensional images (or two-dimensional images supplied by the funeral director).

The embodiments shown and described are merely for illustrative purposes only. The drawings and the description are not intended to limit in any way the scope of the claims. Those skilled in the art will appreciate various changes, modifications, and other embodiments. For example, the button medallion disclosed herein can be mounted on cremation urns as well as caskets. It can be presented to a friend, family member, or loved one of the deceased as a keepsake, with or without the cremation urn button. All such changes, modifications and embodiments are deemed to be embraced by the claims. Accordingly, the scope of the right to exclude shall be limited only by the following claims and their equivalents.

What is claimed is:

1. A casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, said cap panel comprising a sheet of magnetic material, and at least one medallion removably mounted on said cap panel, said medallion having at least one of text and graphics representing a life aspect of the deceased, wherein said medallion comprises:

a medallion blank having at least one magnet on a rear side thereof and having a recess on a front side thereof, and a button removably received in said recess of said medallion blank, said button comprising a button front, a magnetic metallic button back, and a two-dimensional image overlying an upper surface of said button front, said two-dimensional image being said at least one of text and graphics, said at least one magnet removably securing said medallion blank to said magnetic material of said cap panel, said at least one magnet removably securing said button in said recess of said medallion blank.

2. The casket of claim 1 wherein said button front is metallic, a transparent sheet of material overlies said two-dimensional image, and a circumferential edge of said button front is crimped to a circumferential edge of said button back securing said two-dimensional image and transparent sheet of material to said button.

3. The casket of claim 1 wherein said medallion blank is circular and said recess in said medallion blank is circular.

4. The casket of claim 3 wherein said medallion blank further includes a circumferential groove between a periphery of said recess and a periphery of said medallion blank.

5. A method of personalizing a casket, the casket comprising a casket shell adapted to receive the remains of a deceased and having a pair of side walls, a pair of end walls, and a bottom wall and a casket cap closable on the casket shell, the cap including a dish assembly mounted to an underside thereof, the dish assembly including a cap panel, the cap panel comprising a sheet of magnetic material, the method comprising the steps of:

providing a medallion blank having at least one magnet on a rear side thereof and having a recess on a front side thereof, assembling a button comprising a button front, a magnetic metallic button back, and a two-dimensional image overlying an upper surface of the button front, removably securing the button in the recess of the medallion blank via the at least one magnet on the rear side of the medallion blank, and removably securing the medallion blank to the magnetic material of the cap panel via the at least one magnet on the rear side of the medallion blank.

6. The method of claim 5 wherein the step of assembling the button further comprises receiving the two-dimensional image from a loved one of the deceased.

7. The method of claim 6 wherein the button front is metallic, and wherein step of assembling the button further comprises the steps of:

overlying the button front with the received two-dimensional image, overlying the two-dimensional image with a transparent sheet of material, and crimping a circumferential edge of the button front to a circumferential edge of the button back to secure the two-dimensional image and transparent sheet of material to the button.

8. The method of 7 wherein the medallion blank is circular and the recess in the medallion blank is circular.

9. The method of claim 8 wherein the medallion blank further includes a circumferential groove between a periphery of the recess and a periphery of the medallion blank.

10. A casket comprising:

a casket shell adapted to receive the remains of a deceased and having a pair of side walls, a pair of end walls, and a bottom wall, a casket cap closable on said casket shell, said cap including a dish assembly mounted to an underside thereof, said dish assembly including a cap panel, said cap panel comprising a sheet of magnetic material, and at least one medallion removably mounted on said cap panel, said medallion having at least one of text and graphics representing a life aspect of the deceased, wherein said medallion comprises:

a medallion blank having at least one magnet on a rear side thereof and having a recess on a front side thereof, and a button received in said recess of said medallion blank, said button comprising a button front, a button back, and a two-dimensional image overlying an upper surface of said button front, said two-dimensional image being said at least one of text and graphics, said at least one magnet removably securing said medallion blank to said magnetic material of said cap panel.

11. The casket of claim 10 wherein said button is removably received in said recess of said medallion blank.

12. The casket of claim 10 wherein said button front and back are metallic, a transparent sheet of material overlies said two-dimensional image, and a circumferential edge of said button front is crimped to a circumferential edge of said button back securing said two-dimensional image and transparent sheet of material to said button.

13. The casket of claim 10 wherein said medallion blank is circular and said recess in said medallion blank is circular.

14. A method of personalizing a casket, the casket comprising a casket shell adapted to receive the remains of a deceased and having a pair of side walls, a pair of end walls, and a bottom wall and a casket cap closable on the casket shell, the cap including a dish assembly mounted to an underside thereof, the dish assembly including a cap panel, the cap panel comprising a sheet of magnetic material, the method comprising the steps of:

providing a medallion blank having at least one magnet on a rear side thereof and having a recess on a front side thereof, assembling a button comprising a button front, a button back, and a two-dimensional image overlying an upper surface of the button front, securing the button in the recess of the medallion blank, and removably securing the medallion blank to the magnetic material of the cap panel via the at least one magnet on the rear side of the medallion blank.

15. The method of claim 14 wherein the step of assembling the button further comprises receiving the two-dimensional image from a loved one of the deceased.

16. The method of claim 14 wherein the button front and back are metallic, and wherein step of assembling the button further comprises the steps of:

overlying the button front with the received two-dimensional image, overlying the two-dimensional image with a transparent sheet of material, and crimping a circumferential edge of the button front to a circumferential edge of the button back to secure the two-dimensional image and transparent sheet of material to the button.

17. The method of 14 wherein the medallion blank is circular and the recess in the medallion blank is circular.

18. The method of claim 17 wherein the medallion blank further includes a circumferential groove between a periphery of the recess and a periphery of the medallion blank.

19. A medallion for presentation to a loved one of a deceased as a keepsake, said medallion having at least one of text and graphics representing a life aspect of the deceased, said medallion comprising:

a medallion blank having a recess on a front side thereof, and a button received in said recess of said medallion blank, said button comprising a button front, a button back, and a two-dimensional image overlying an upper surface of said button front, said two-dimensional image being said at least one of text and graphics, wherein said button front and back define a cavity adapted to contain cremation remains, said button back including a hole through which the cremation remains may be introduced into said cavity and a closing device for closing said hole to contain the cremation remains in said cavity.

20. The medallion of claim 19 wherein said button is removably received in said recess of said medallion blank.

21. The medallion of claim 20 wherein said medallion blank has at least one magnet on a rear side thereof.

22. The medallion of claim 21 wherein said button comprises a magnetic metallic button back, said at least one magnet removably securing said button in said recess of said medallion blank.

23. The medallion of claim 19 wherein said button front and back are metallic, a transparent sheet of material overlies said two-dimensional image, and a circumferential edge of said button front is crimped to a circumferential edge of said button back securing said two-dimensional image and transparent sheet of material to said button.

24. The medallion of claim 19 wherein said medallion blank is circular and said recess in said medallion blank is circular.

25. The medallion of claim 24 wherein said medallion blank further includes a circumferential groove between a periphery of said recess and a periphery of said medallion blank.

26. The medallion of claim 19 wherein said button front and back are plastic.

* * * * *

UNITED STATES PATENT AND TRADEMARK OFFICE

CERTIFICATE OF CORRECTION

PATENT NO. : 8,555,471 B2
APPLICATION NO. : 13/242594
DATED : October 15, 2013
INVENTOR(S) : Ilija Rojdev It is certified that error appears in the above-identified patent and that said Letters Patent is hereby corrected as shown below:

In the claims

Column 7, line 28, Claim 7, reads: "and wherein step of assembling the button further comprises"; it should read: -- and wherein the step of assembling the button further comprises --.

Column 8, line 32, Claim 16, reads: "back are metallic, and wherein step of assembling the button"; it should read: -- back are metallic, and wherein the step of assembling the button --.

Column 8, line 47, Claim 19, reads: "19. A medallion for presentation to a loved one of a"; it should read: -- 19. A medallion for at least one of attachment to a casket, attachment to a cremation urn, and for presentation to a loved one of a --.

Signed and Sealed this
Fifth Day of January, 2016

Michelle K. Lee

Michelle K. Lee
*Director of the United States Patent and Trademark Office*